US005810089A

United States Patent [19]

Mack

[11] Patent Number: 5,810,089

[45] Date of Patent: Sep. 22, 1998

[54] PORTABLE FIREFIGHTING APPARATUS WITH INTEGRAL CONTROL VALVE-HANDLE

[75] Inventor: Ross Julian Mack, Valparaiso, Ind.

[73] Assignee: Task Force Tips, Inc., Valparaiso, Ind.

[21] Appl. No.: 634,809

[22] Filed: Apr. 19, 1996

[51] Int. Cl.[6] ..... A62C 5/02

[52] U.S. Cl. ..... 169/15; 251/344

[58] Field of Search ..... 169/14, 15; 251/252, 251/344; 137/892, 893

[56] References Cited

U.S. PATENT DOCUMENTS

| | | | |
|---|---|---|---|
| 2,058,901 | 10/1936 | McPherson | 137/393 X |
| 4,396,154 | 8/1983 | Iovino et al. | 251/344 X |
| 5,009,244 | 4/1991 | Grindley et al. | 137/101.11 |
| 5,054,688 | 10/1991 | Grindley | 239/407 |
| 5,137,094 | 8/1992 | Broussard | 169/15 |
| 5,165,442 | 11/1992 | Fiala | 137/118.04 |

OTHER PUBLICATIONS

Bulletin of Hypro Corporation—Form 852—on Foam Pro Model 1600—dated Feb. 1996.

*Primary Examiner*—Andrew C. Pike
*Attorney, Agent, or Firm*—Marshall, O'Toole, Gerstein, Murray & Borun

[57] ABSTRACT

A combination carrying handle and control valve for fire-fighting apparatus suspends a portable reservoir. A handle is formed by a tubular wall having an inlet end and an outlet end and forming a flow passage between the ends; and a coupling is fastened to the inlet end and another coupling is fastened to the outlet end for connecting the handle to a source of liquid under pressure and to an accessory, respectively. A manually operated flow control valve is mounted in the handle for controlling the flow of liquid. The handle is part of a tank that may contain a liquid additive, and an eductor is connected between the flow passage and the tank interior for drawing the additive from the tank.

14 Claims, 11 Drawing Sheets

PORTABLE FIREFIGHTING APPARATUS WITH INTEGRAL CONTROL VALVE-HANDLE

FIELD AND BACKGROUND OF THE INVENTION

This invention relates generally to a combination valve and carrying handle for use in firefighters portable spraying apparatus.

Chemical agents are frequently added to water by firefighters to enhance the firefighting properties of plain water. These additives include but are not limited to better extinguishment and wetting ability, and for increasing the volume of the water which is useful in blanketing areas with foam. In recent years many types of additives have been found useful for firefighters.

It is apparent that the methods and tactics for applying these different types of chemicals is quite varied; however, the usefulness and effectiveness of adding chemical concentrates to plain water is well known to the modern firefighting services.

The addition of chemical concentrates to water by fire department personnel has been done in a variety of ways, but can be generally classified into two methods. One method is to add the concentrate to the water at or near the fire truck. The second method is to add the concentrate approximately at the point of usage, that being the discharge end of the fire hose.

While portable foam reservoirs containing water and foam concentrate in either liquid of pellet form have been used for several years, such as the rigid fire extinguisher canister type sold by 3M, or the flexible backpack type as manufactured by Scott Plastics Ltd. of Victoria, B.C. Canada, they have substantially limited usefulness as a portable unit because of the small size of the reservoir, and will not achieve the effectiveness of the present invention if constructed of an equal weight.

The present invention relates to point of usage type of proportioning systems connectable to a pressurized source of water by a hose. Point of usage proportioning systems can be further divided into those systems that have the concentrate pumped through a separate hose to the point of usage, and those systems generally referred to as portable. The present invention is considered portable, and further discussion is directed to portable systems connected to a pressurized source of water such as a fire hose.

Portable proportioning systems are intended to be stored in a ready to use condition so that they can be quickly deployed by a single person. Adding concentrate at the point of usage with portable systems has in the past been generally limited to smaller applications of foam because of the logistical limitations of having to carry the concentrate to and around with the end of the hose. This method however can be advantageous over truck dispensed concentrate systems because the person applying the foam can control the dispensing of the foam concentrate. In truck mounted systems, this control is given to the pump operator who can not see nor respond to the changing fire ground situation as quickly as the person at the end of the hose. This method is advantageous over point of usage methods with pumped concentrate supply for the same reason, and in addition portable systems have increased mobility.

The benefit of releasing a chemical into the environment must be weighed against the potential for damage on the environment. It is becoming increasingly evident that spillage and wastage should be kept to a minimum. Small portable systems can be quickly and easily be brought to the scene of a fire and used with high accuracy so that environmental impact is minimized.

Wheeled carts containing foam reservoirs, a discharge device, and an eductor, such as the AF 120 Mobile foam cart sold by Angus Fire Armour, weighs over 400 lbs (183 KG) when filled with foam. Thus it lacks portability, speed of deployment, and mobility at an emergency scene.

Portable point of usage systems including flexible foam storage bags designed to be worn by the firefighter have also been used. While they may be comfortable to wear for extended periods of time, they must be strapped on, thereby decreasing their speed of deployment. They also include further limitations in that the flow of water through the device is controlled by a quarter turn ball type valve. In the system described in U.S. Pat. No. 5,137,094, operating the valve at partial open positions causes back pressure on the discharge side of the educting device that is connected to the inlet of the quarter turn ball valve. This back pressure prevents the creation of vacuum in the throat of the eductor so that no foam concentrate is educted into the flow of water. Thus if foam is desired the valve must be operated in either the full open or full closed positions. The quarter turn ball valve of this device when operated in a partial open position will create turbulence in the spray pattern thereby limiting its effectiveness. This system also requires the operator to use two hands to change the position of the valve handle, one to hold the nozzle and the other to push the valve handle. There must be a check valve in the concentrate delivery tube to prevent back flow of water from the eductor throat into the reservoir. Check valves are prone to clogging, or impeding concentrate flow in cases where the proportion of additive desired is extremely small, as is the case when dispensing concentrates with viscosity over 50 Centipoise at less than 1% ratio of concentrate to water.

Scott Plastics Ltd. in Victoria BC Canada manufactures a variety of portable proportioning systems referred to as Back-pack, Hip-pack, Four Litre Foam Kit, Garden Hose Foam Kit, or Helitack Foam Kit. In these systems, a quarter turn ball valve is connected to an eductor, which discharges to nozzles of various types. This arrangement overcomes the limitations of having to operate the valve in either full on or full off positions, but still requires the operator to use both hands when changing valve position, thus limiting its usefulness. Check valves are not required on these systems.

In Europe, a portable point of usage proportioning system has been manufactured by Delta Fire in the UK. This system includes a carrying handle on the top of the tank. The system can be quickly picked up, and carried to the scene. This system also includes a quarter turn ball valve that discharges to an eductor that discharges to a length of hose about one meter long. The discharge end of the hose is equipped with rapid connectors so that either low expansion or medium expansion foam aspirating nozzles can be connected to a discharge hose. The valve is useful for modulating flow between full on and full off positions. In use, one carries the tank by its handle in one hand, and sprays from the discharge nozzle with the other. When the user wants to change the position of the valve, the tank must be set down, and the valve handle adjusted. During this time, the operator is distracted from the task at hand. The valve handle is situated behind the carrying handle in an area that is prone to being bumped by the operator so that valve adjustment is a frequent nuisance.

The aforementioned systems have the disadvantage that they cannot be operated with one hand, and none can be simply set upon a deck or bumper of a moving vehicle to discharge foam in a desired direction.

SUMMARY OF THE INVENTION

It is a general object of the present invention to provide an improved system which avoids the disadvantages of the prior art.

Apparatus in accordance with the present invention comprises a portable point of usage storage tank with a proportioning system and a modulating valve that also serves as a carrying handle and is connectable to a water source. A variety of discharge accessories are connectable to a discharge end of the combination valve-handle. The apparatus includes an inlet connectable to a pressurized water source such as a fire hose, and a valve which modulates and controls the passage of water through an eductor. Flow of pressurized water through the eductor causes a partial vacuum to be created in the throat of a constricted section whereby a water additive, such as but not limited to foam concentrate, can be drawn into the throat by means of a flow passage established between the throat and a liquid additive reservoir in a portable tank. The flow of liquid additive is regulated by an adjustable orifice to control the proportion of additive into the flow of water. The liquid additive and the water are combined at the throat of the eductor, and are discharged through a flow path that is connectable to a discharge attachment or accessory. The water flow modulating valve also serves as a carrying handle for the portable tank.

BRIEF DESCRIPTION OF THE DRAWINGS

The foregoing and other objects and advantages of the present invention will become apparent from the following detailed description taken in conjunction with the accompanying figures of the drawings, wherein.

DETAILED DESCRIPTION OF THE DRAWINGS

Figure 1:
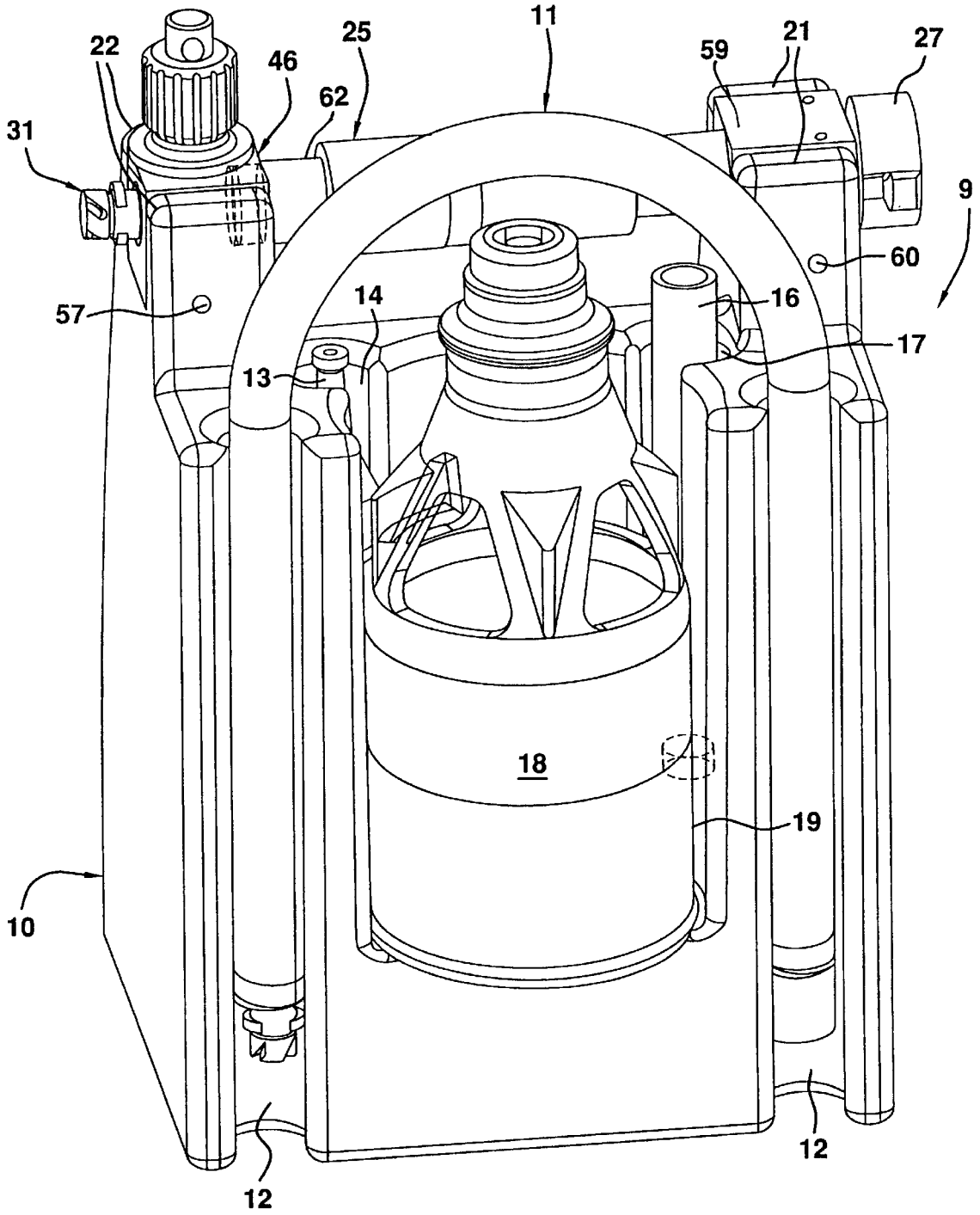
FIG. 1 is a perspective view of a kit including apparatus in accordance with this invention.

With reference first to FIG. 1, there is illustrated a spraying system or kit 9 primarily for use by firefighters, which includes a hollow tank 10 that forms an internal fluid reservoir. The tank 10 is constructed, for example, of a strong molded plastic and has formed therein a plurality of storage recesses for accessories. The accessories include a short length of hose 11, the ends of which are held in storage recesses 12, a straight jet nozzle 13 which is held in a recess 14, a low expansion nozzle 16 which is held in a recess 17, and a medium expansion nozzle 18 which is held in a recess 19. Extending upwardly from the top side of the tank 10 are two pairs of projections 21 and 22, the projections of each pair being spaced apart. Extending between the projections of the two pairs is a combination carrying handle and valve 25 (referred to herein as the valve 25), to be described in more detail hereinafter.

Figure 2:
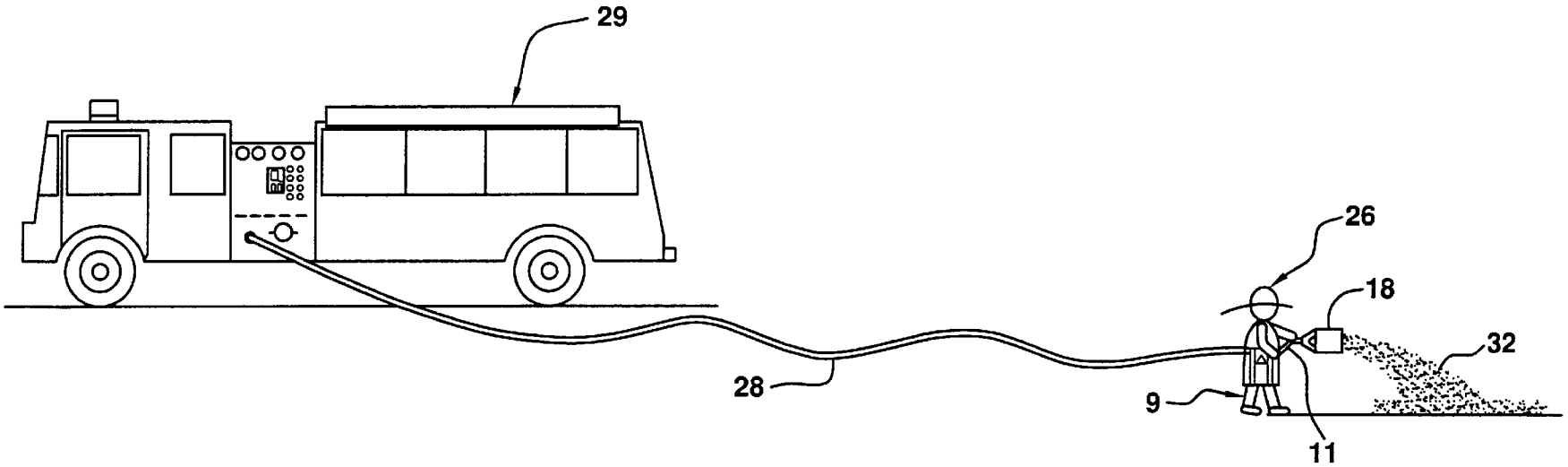
FIG. 2 is a view illustrating a fire scene including the kit of FIG. 1, in use on a fire.

FIG. 2 shows the kit 9 in use. The kit 9 is carried by a firefighter 26. The reservoir of the tank 10 contains a liquid additive; the intake end 27 (FIG. 1) of the valve 25 is coupled by a hose 28 to a source 29 of water under pressure, in this instance a fire engine. Coupled to the outlet end 31 of the valve 25 is one end of the hose 11, and the nozzle 18 is coupled to the other end of the hose 11. In this example, the liquid additive is a conventional concentrated liquid foaming agent, and it is mixed with the water flowing through the valve 25. The nozzle 18 aerates and sprays a foam product 32.

Figure 3:
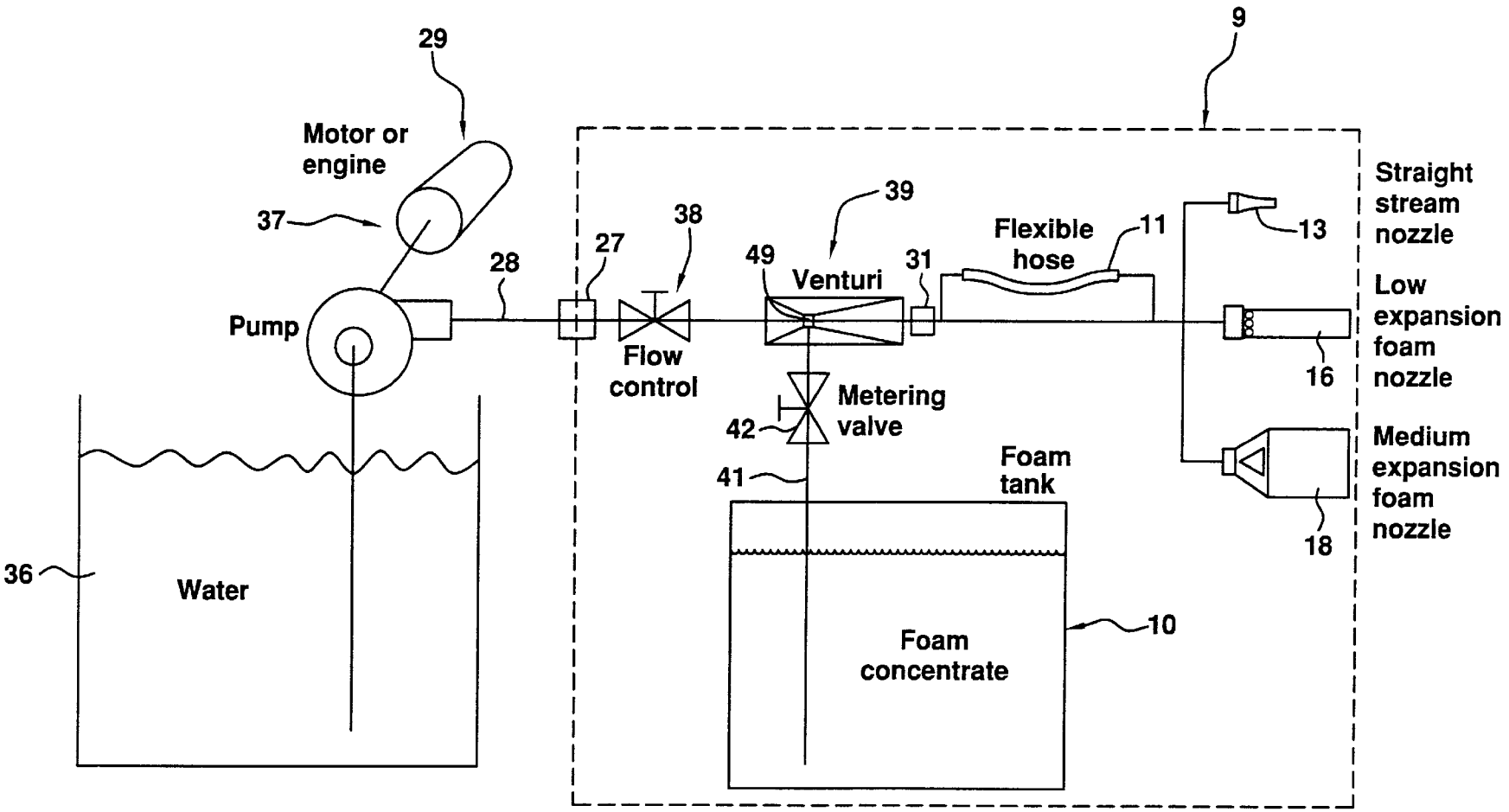
FIG. 3 is a schematic diagram of the elements shown in FIG. 2.

FIG. 3 is a schematic illustration of the components shown in FIGS. 1 and 2. The engine 29 includes a supply of water 36 which is moved by a pump-motor unit 37 through the hose 28. The valve 25 includes an adjustable flow control valve 38 which controls the volume of water. A venturi 39 is mounted in the stream of water downstream from the valve 38. Connected to the throat of the venturi 39 is a tube 41 which extends to near the bottom of the tank 10, and a partial vacuum formed in the throat draws the liquid additive out of the reservoir and mixes it with the water. An adjustable valve 42 adjusts the proportion or the additive-water ratio. Thus the components 39, 41, and 42 form an eductor system which draws the liquid additive from the tank 10.

Figure 12:
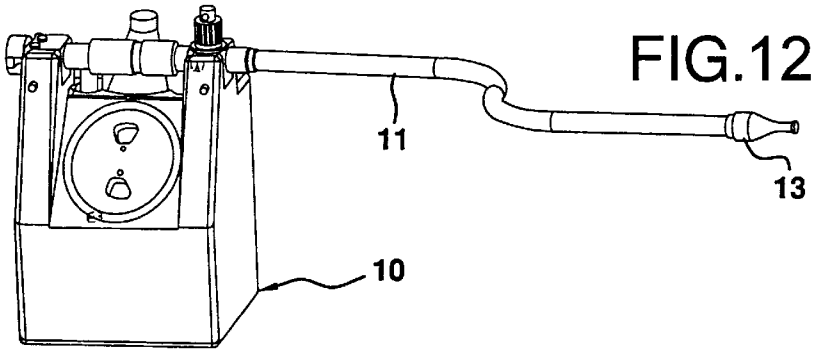
FIGS. 9 to 14 are perspective views illustrating several possible combinations of accessories of the apparatus.
Figure 13:
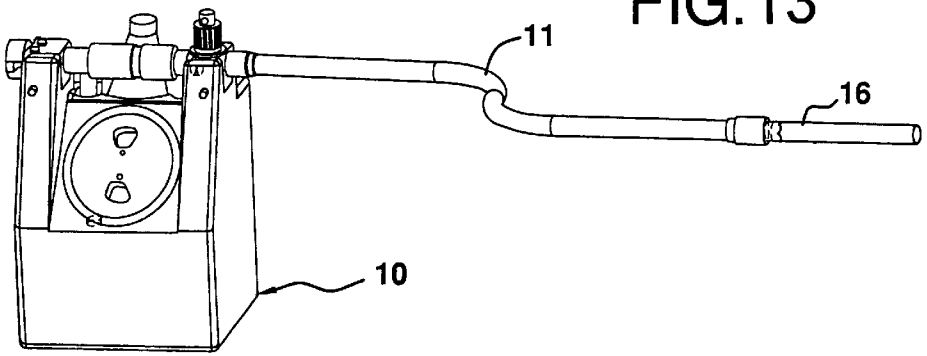
Figure 14:
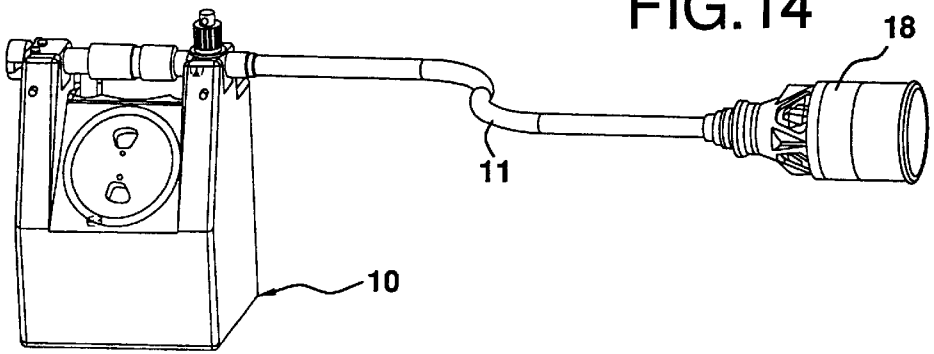
Figure 9:
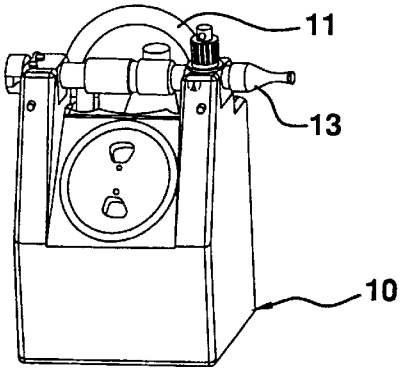
Figure 10:
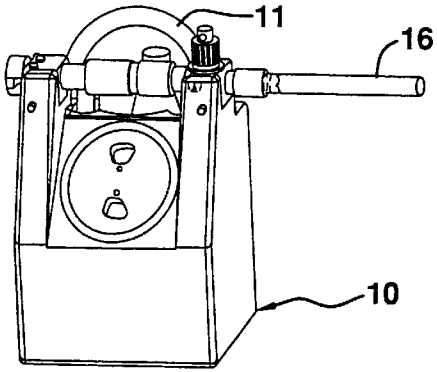
Figure 11:
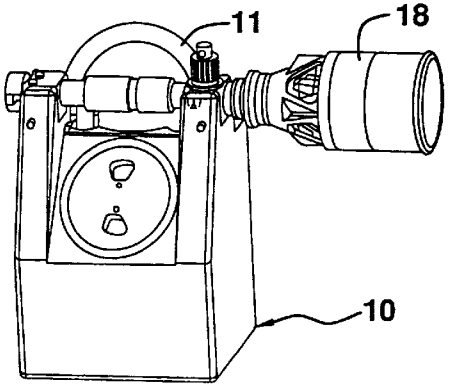

The end 31 of the valve 25 forms one-half of a coupling such as a quick connect or screw coupling. The other half of the coupling is included in each of the three nozzles. Consequently, as shown in FIGS. 9 to 11, any one of the three nozzles 13, 16, and 18 may be attached to the end 31. The hose 11 has, at one end thereof, a coupling half which is also connectable with the end 31 of the valve. The other end of the hose 11 has a coupling half which is identical with the end 31, whereby the hose 11 may be interposed between the end 31 and any one of the three nozzles 13, 16, and 18 as shown in FIGS. 12 to 14.

Figure 4:
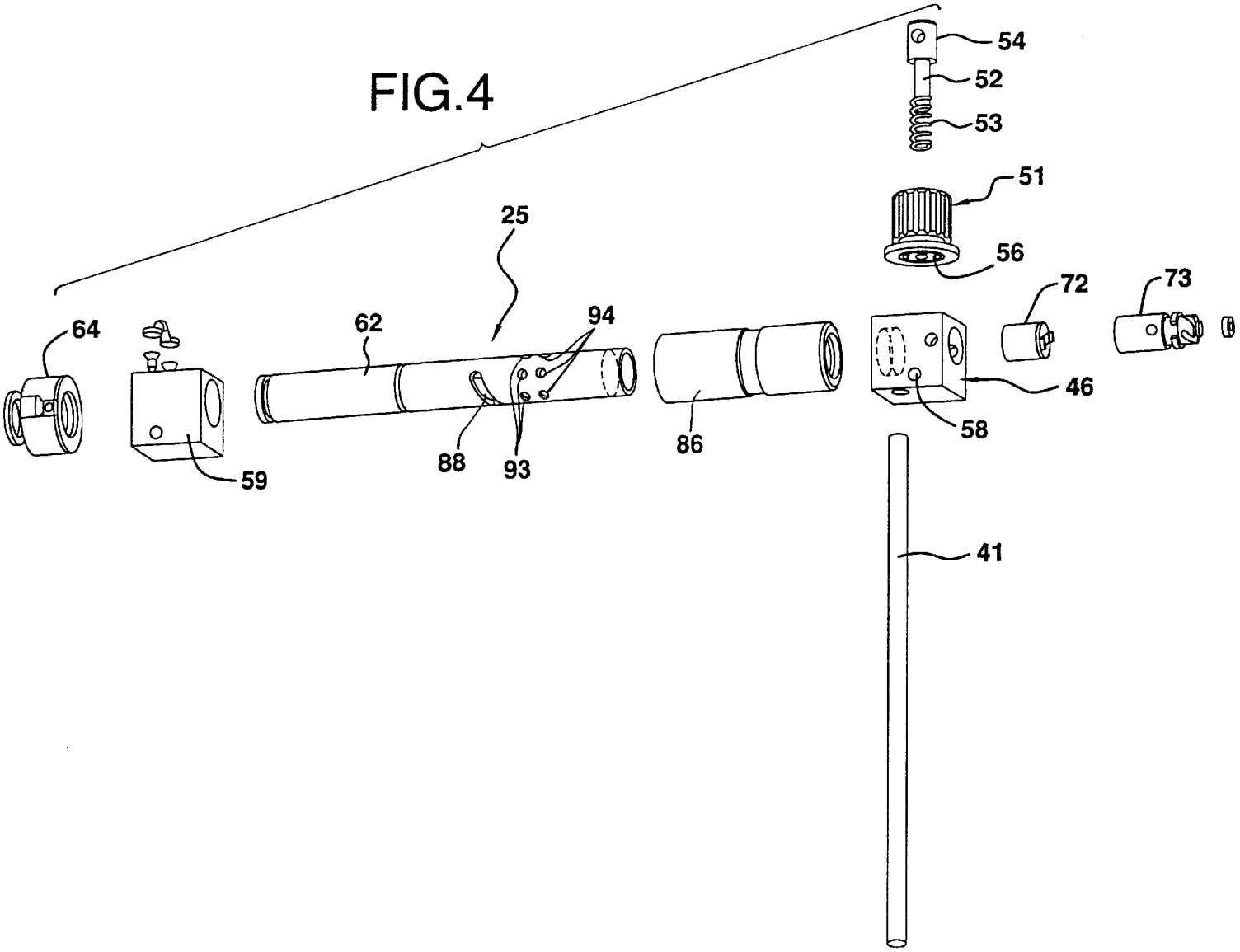
FIG. 4 is an exploded perspective view of a combination carrying handle, modulating valve, and eductor components in accordance with this invention.
Figure 6:
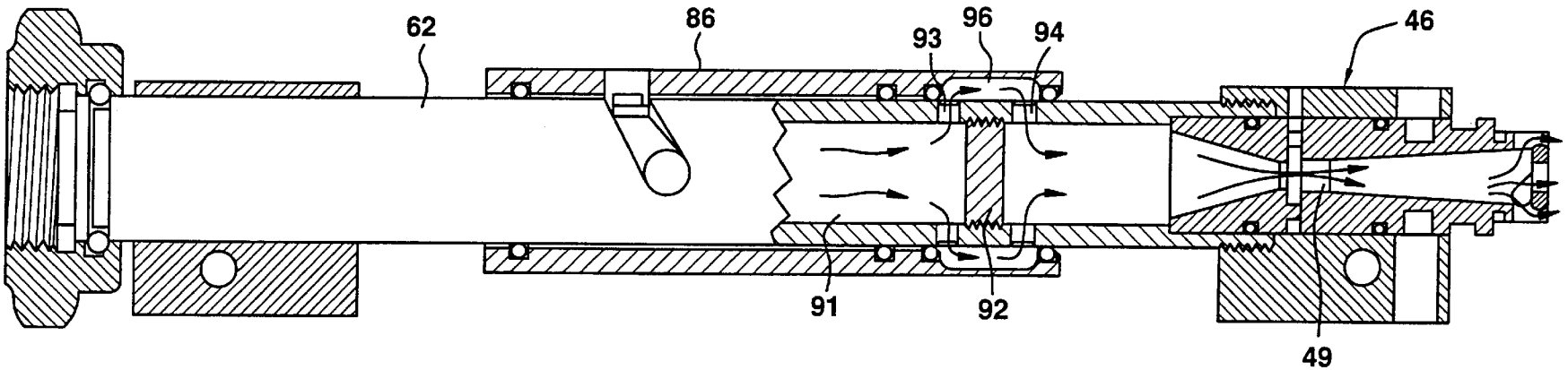
FIG. 6 is a cross-sectional view similar to FIG. 5, but showing the modulating valve in the fully open position.
Figure 7:
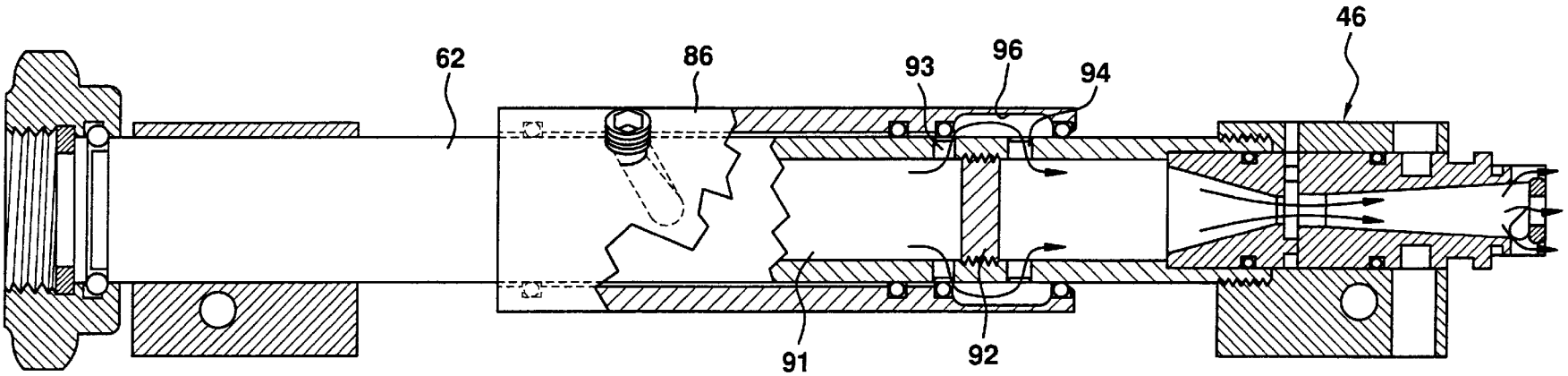
FIG. 7 is a cross-sectional view similar to FIGS. 5 and 6 but showing the modulating valve in a position between closed and full open.
Figure 8:
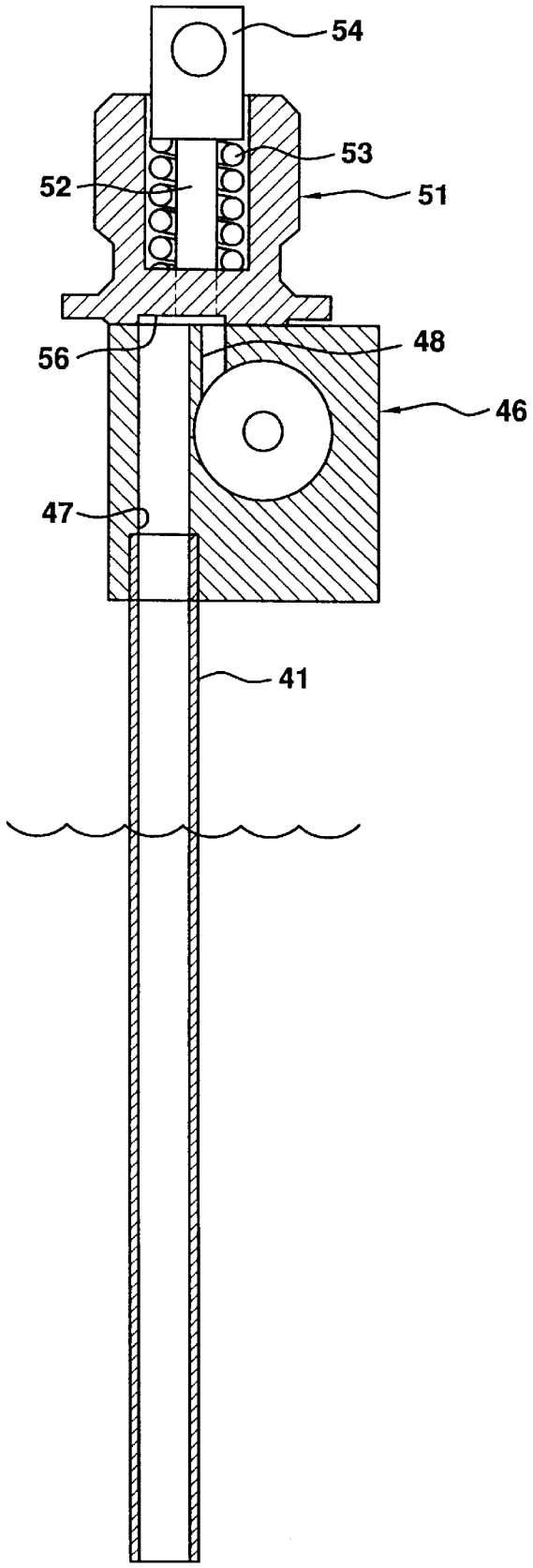
FIG. 8 is a sectional view of an eductor and control valve.

FIGS. 4 to 8 illustrate in detail the construction and operation of the valve 25 and the eductor components. In FIG. 4, the additive pickup tube 41 that extends into the tank reservoir (see FIG. 3) is substantially sealed at its upper end into an eductor housing block 46 (also see FIG. 8). The tube 41 delivers additive through a vertical hole 47 extending through the block 46. A second parallel vertical hole 48 in the eductor housing block 46 is connected to the throat 49 (FIG. 3) of the eductor venturi 39 located in the block 46. A knob 51 is rotatably mounted on the top side of the eductor housing block 46 by means of a stud 52 which is threaded into the block 46, compression spring 53, and locking bolt 54. The spring 53 presses the lower face of the rotatable knob 51 against the upper face of the eductor housing block 46. This force both retains the rotatable knob at a set position as well as forms a substantially leak-free seal between the knob 51 and block face, thus preventing flow communication between the atmosphere and the two vertical holes 47 and 48. On the underside of rotating knob 51 is formed one or more recesses 56 (FIG. 8). When a recess 56 is aligned between and bridges across or connects with the upper ends of the two vertical holes 47 and 48 in eductor block 46, a flow communication path is formed between them. The size of the flow area of this communication path is proportional to the cross sectional area of the recess 56 between the vertical holes 47 and 48, and the size of one or more recesses 56 may be calibrated to deliver a desired percentage of concentrate into the throat 49 of the venturi. The recess size may also be shaped to produce a gradually increasing flow area so that the proportion of concentrate educted can be modulated. Two or more recesses 56 may be provided with blank sections formed between the adjacent edges of the recesses, so that the knob 51 may be rotated to a position to occlude both holes 47 and 48 and prevent flow communication between the two vertical holes.

With reference again to FIG. 1, the block 46 is positioned between the two projections 22 on the upper side of the tank 10. The block 46 is secured to the projections 22 as by a cross retainer pin 57 which extends through cross holes in the projections 22 and a hole 58 (FIG. 4) in the block 46. A second block 59 is similarly positioned between the other two projections 21 and fastened thereto by a retainer pin 60. Preferably the pins 57 and 60 are removable so that the blocks 46 and 59 may be withdrawn.

Figure 5:
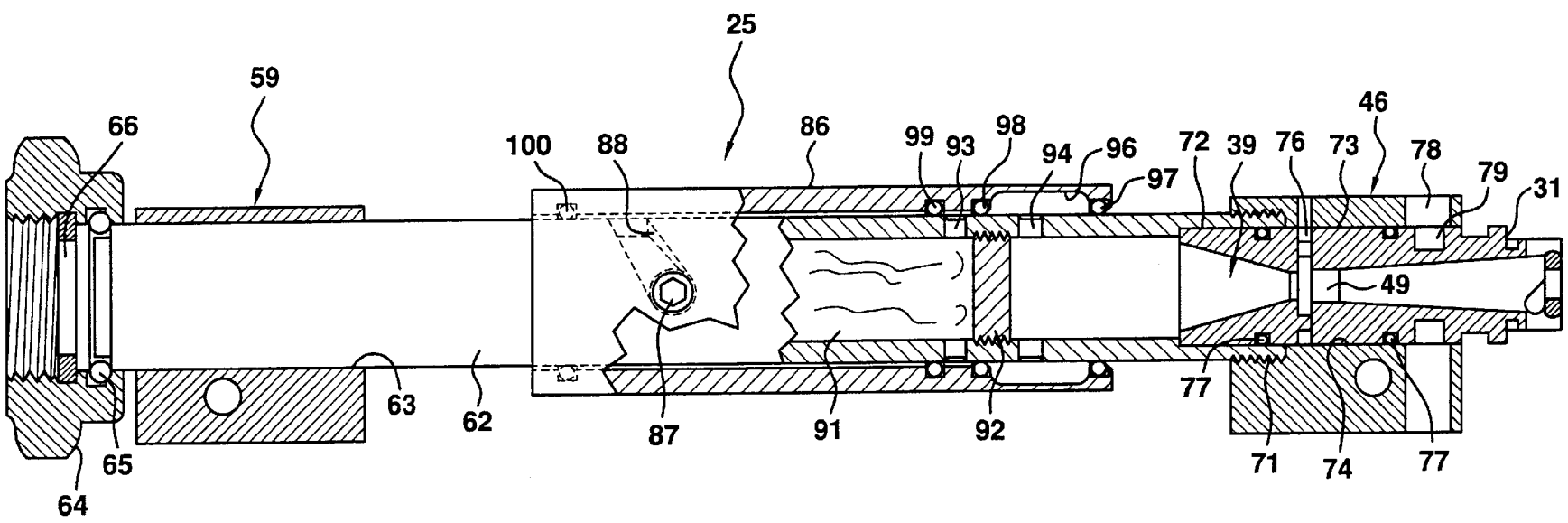
FIG. 5 is an enlarged cross-sectional view of the combination carrying handle, modulating valve, and eductor, showing the modulating valve in the closed position.

With reference to FIGS. 4 and 5, the valve 25 comprises a tubular part referred to herein as a handle 62. The handle 62 extends through a hole 63 formed in the block 59, and a swivel nut 64 is fastened to the end of the handle 62 as by a split ring 65. The nut 64 is preferably shaped to be attached to a standard hose coupling (not shown), and a circular seal 66 forms a leakproof connection with the hose.

At the other end of the handle, there is a threaded connection 71 between the block 46 and the end of the handle 62. The venturi 39 is formed within two members 72 and 73. The member 72 is positioned in a counterbore formed within the end of the handle 62, and the part 73 extends through a hole 74 in the block 46 with one end abutting the member 72. The throat 49 of the venturi 39 is located adjacent the adjoining ends of the members 72 and 73, and a passage 76 between the two members 72 and 73 extends from the throat and to the hole 48 (FIG. 8). O-ring seals 77 form sealed connections between the members 72 and 73 and the handle 62 and the block 46, respectively. The member 73 is secured to the block 46 by at least one screw 78 which is threaded through the wall of the block 46 and engages a groove 79 in the member 73. The end 31 of the member 46 forms a coupling half for connection to the accessories as previously mentioned. The end 31 may be constructed as illustrated in FIGS. 5, 6, and 7 or as described in the above-mentioned application of R. W. Steingass and R. J. Mack.

The tubular handle 62 is preferably made of a strong metal so that it is sturdy enough to enable a firefighter to carry the tank 10 plus accessories with the tank filled with a liquid additive. The tubular handle 62 forms a liquid flow channel, and a flow control valve is mounted in the channel. The control valve is variable between full on and closed positions, and it is preferably adjustable to modulate the flow between full on and closed. It is also preferred that manual control be effected by rotation or turning movement of a part on the handle 62. A variety of valve designs are available for this purpose, such as the control valve described in the C. H. McMillan U.S. Pat. No. 4,252,278 or the valve described in the U.K. patent application No. publication no. 2,256,029 published Nov. 25, 1992.

In the specific example of the invention described herein, the valve comprises a movable tubular sleeve 86 which is around the outside of the handle 62 and is coupled to the handle 62 by a screw pin 87. The outer surface of the handle 62 has an angled or spiral groove 88 formed in it, and the pin 87 extends into the groove 88. Since the groove 88 is angled, rotation of the sleeve 86 plus the pin 87 relative to the handle 62 causes the sleeve to move axially along the length of the handle 62.

With reference to FIG. 5, the tubular handle 62 forms the above-mentioned interior flow channel 91, and at an intermediate location in the channel 91 is secured a plug 92 which blocks the channel 91. A plurality of radially extending upstream holes 93 are formed through the wall of the handle 62 just upstream of the plug 92, and a plurality of radially extending downstream holes 94 are formed through the wall of the handle 62 just downstream of the plug 92. An annular groove 96 is formed in the interior surface of the sleeve 86 and forms a flow passage. The axial length of the groove 96 is such that it is able to bridge the upstream and downstream sets of holes 93 and 94, as shown in FIG. 6. Two axially spaced O-rings 97 and 98 at opposite ends of the groove 96 form seals between the sleeve 86 and the handle 62. A third O-ring 99 is provided upstream of the seal 98, and the seals 98 and 99 are spaced apart a distance which is slightly greater than the axial dimension of the holes 93. A fourth seal 100 is preferably provided upstream of the pin 87 and the groove 88 to keep dirt from collecting within the sleeve 86.

FIG. 5 shows the modulating valve 25 in the closed position. Assuming that the end coupling 64 is attached to a hose, water enters the channel 91. In the position shown, the rotatable sleeve 86 is in the extreme forward position wherein the plug 92 blocks flow through the channel 91 and the seals 98 and 99 prevent flow out of the holes 93.

FIG. 6 shows the modulating valve in the fully open position. The sleeve 86 has been rotated to move it to the extreme rearward position, and there is communication between the upstream holes 93 and downstream holes 94 through the flow passage 96 formed inside the sleeve 86. The combined flow area of the holes 93 and 94 is preferably substantially greater than the flow area through the throat 49 of the eductor or venturi. When the valve is in this position, the throat 49 of the eductor becomes the limiting restriction in the system, and maximum flow is achieved. For a straight jet nozzle application this will yield the discharge spray with the greatest exit velocity which is useful for penetration, impact, and distance.

FIG. 7 shows the modulating valve in an intermediate position between closed and full open. In the position shown of the sleeve 86, the groove 96 partially opens the holes 93. Modulating the valve to an intermediate position as shown is useful for several purposes. In one case it allows the operator to control the quality of the foam being produced. This is particularly important when using a foam nozzle to create thick blankets of medium expansion foam because the best foam expansion tends to be at nozzle discharge pressures between 25 and 75 PSI (about 2–5 BAR). If the system is connected to a high pressure pump that is delivering 400 PSI (27 BAR) for example, then the losses through the modulating valve, and eductor need to be approximately 350 PSI (23 BAR). When one desires low expansion foam, the nozzle discharge pressure tends to be far less sensitive, with the best results being achievable at pressures between 50 and 150 PSI (3–10 BAR).

However foam quality is not the only consideration. In many circumstances a certain reach is desired. Modulating the valve opening will instantly give the desired results. In yet other cases, water conservation is a key concern because of limited supplies on board a fire truck for example, and thus the operator can instantly modulate the valve opening to conserve water, or even create just a small sprinkle to quench some embers for example. It is then understood that modulating the valve will maximize the effectiveness of the discharge, and in so doing it also minimizes the release of chemical agents into the environment.

In addition to controlling the volume of water by means of the valve 25 (by rotating the sleeve 86), the amount of the additive drawn from the tank 10 may be controlled using the knob 51.

FIGS. 9 to 14 are perspective views showing use of the system accessories including several possible combinations of discharge devices and the hose.

FIG. 9 shows a straight jet nozzle on eductor discharge. This is useful for application of plain water or wetting agents, with the operator using only one hand. The operator's other hand can be used for carrying another tool, a radio, or other device.

FIG. 10 shows a low foam expansion nozzle on eductor discharge, which is useful for application of wet sloppy foam using one hand. Again, the other hand is free to accomplish another task, such as carrying another tool, a radio, or other device.

FIG. 11 shows a medium foam expansion nozzle on tank, which is useful for purposes such as, but not limited to, vapor suppression, blanketing, or the creation of fire breaks in grass or cropland.

FIG. 12 shows a straight jet nozzle and a hose on eductor discharge. This combination is capable of giving maximum reach.

FIG. 13 shows a low foam expansion nozzle and hose on eductor discharge. This is useful for maximum extinguishing ability on CLASS B fires, or wet sloppy foam for penetration in CLASS A fuels.

FIG. 14 shows a medium foam expansion nozzle and a hose on eductor discharge. This combination gives maximum maneuverability when covering large areas with thick foam blankets.

Figure 15:
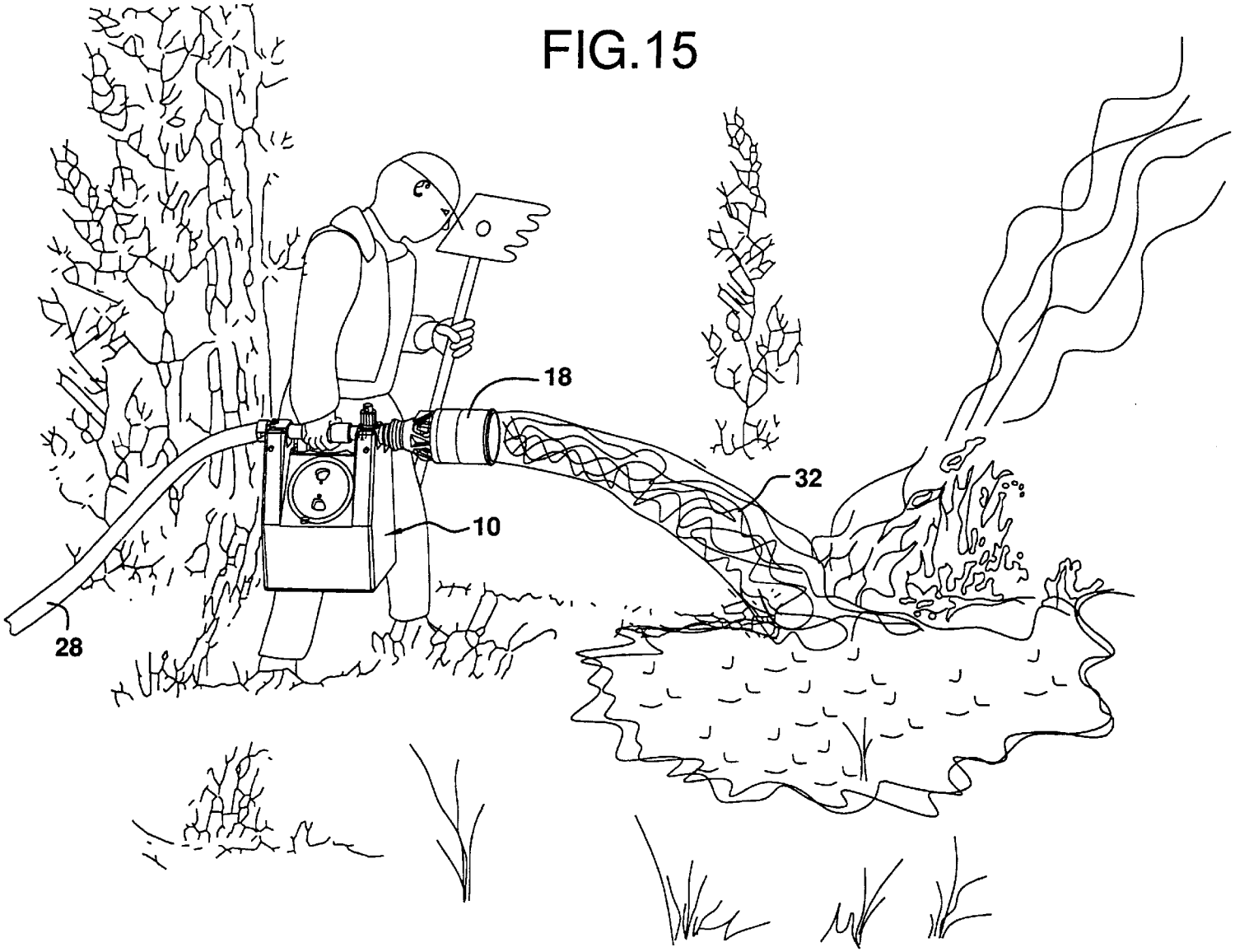
FIG. 15 is a perspective view of the apparatus being operated with one hand.

FIG. 15 is a pictorial illustration of the use described in connection with FIG. 11, with the system being operated with one hand. The other hand is free to accomplish another task, such as carrying another tool, radio, or other device.

Figure 16:
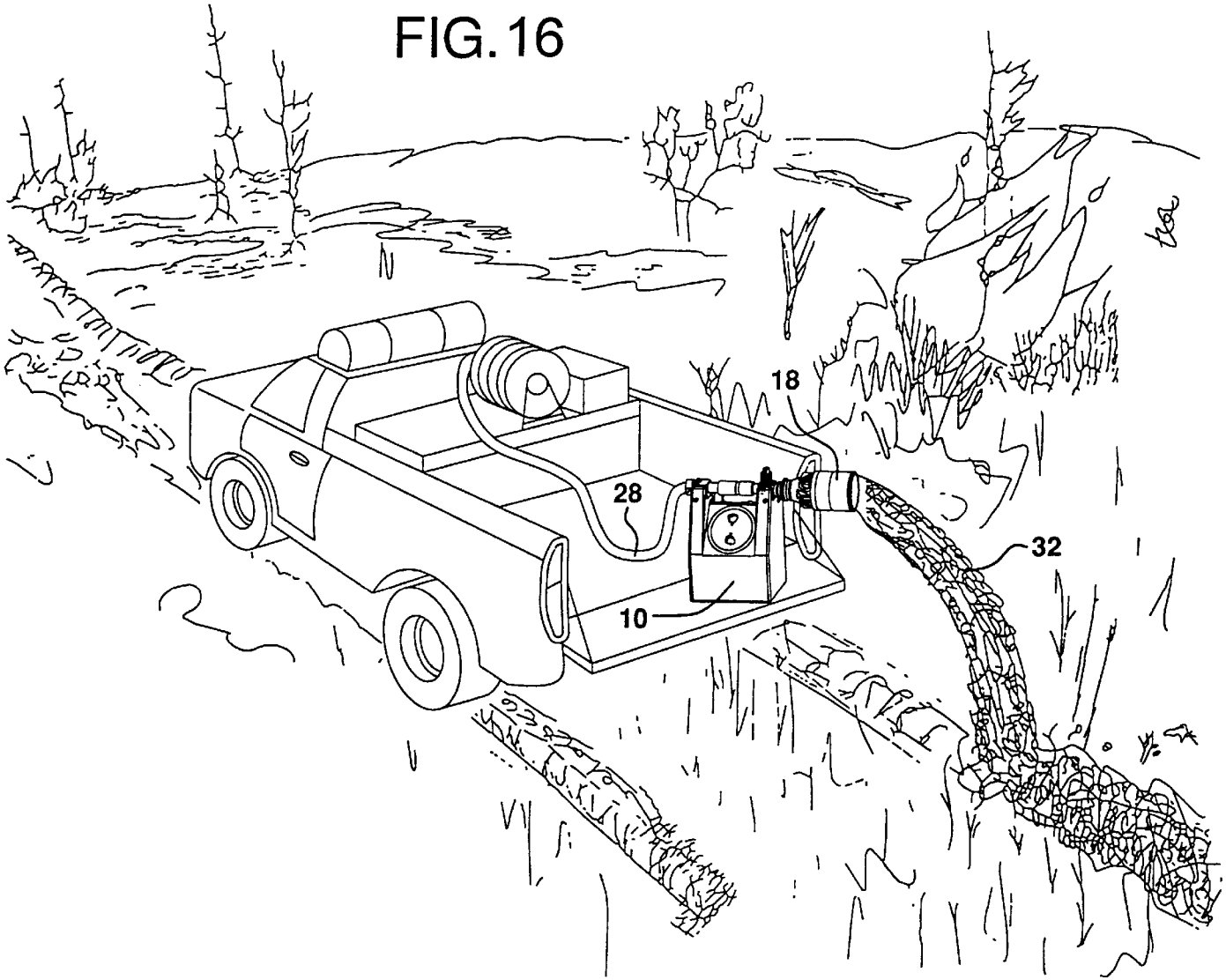
FIG. 16 is a perspective view of the kit discharging foam from a moving vehicle.

FIG. 16 is a perspective view showing the system discharging foam from the truck bed of a moving vehicle. Instead, the system may be mounted on the front bumper of a truck, for example, and a line of thick foam dispensed and driven over, thereby forming a fire break by trampling and wetting a line of grass or cropland fuel. The fuel standing between the fire break and the fire can be ignited to burn back towards the oncoming fire thereby stopping it when the flame fronts meet.

It will be apparent from the foregoing that apparatus in accordance with this invention provides a modulating valve that also serves as a carrying handle. With one hand, an operator is able to carry the system and turn the sleeve 86 to adjust the volume of water being dispensed. Various liquid additives may be mixed with the water, and the knob 51 may be adjusted to vary the amount or close the connection between the passages 47 and 48.

What is claimed is:

1. Apparatus comprising:

a portable reservoir;

a handle defining a bore therethrough, said bore having an inlet and an outlet, said handle being adapted to suspend said reservoir;

a valve disposed in said bore for controlling flow of pressurized fluid therethrough; and a valve controller operatively connected to said handle and being adapted to suspend said handle when said handle is suspending said reservoir.

2. Apparatus comprising:

a portable reservoir;

a handle formed by a tubular wall having an inlet end and an outlet end and forming a flow passage between said ends, said handle being adapted to suspend said portable reservoir;

coupling means fastened to said inlet end and to said outlet end for connecting said handle to a source of liquid under pressure and to an accessory, respectively; and control valve means in said flow passage for controlling a flow of the liquid through said flow passage, said control valve means including a manually movable control member adapted to suspend said portable reservoir.

3. Apparatus as set forth in claim 2, wherein said control member is turnable relative to said tubular wall.

4. Apparatus as set forth in claim 3, wherein said control member comprises a sleeve on said tubular wall, said control member being movable rotationally and axially relative to said tubular wall.

5. Apparatus as set forth in claim 2, and further including a tank forming said reservoir for liquid additive, and educator means between said reservoir and said flow passage for drawing the liquid additive out of said reservoir, said educator means being downstream of said control valve means.

6. Apparatus comprising:

a portable reservoir;

a handle formed by a tubular wall having an inlet end and an outlet end and forming a flow passage between said ends, said handle being adapted to suspend said portable reservoir;

coupling means fastened to said inlet end and to said outlet end for connecting said handle to a source of liquid under pressure and to an accessory, respectively;

plug means in said flow passage for blocking liquid flow straight through said flow passage;

at least one downstream hole through said wall between said plug means and said outlet end;

at least one upstream hole through said wall between said plug means and said inlet end;

a sleeve movably mounted around said tubular wall and covering said upstream hole and said downstream hole, and adapted to suspend said portable reservoir;

a recess in said sleeve adjacent said tubular wall and having a dimension sufficient to bridge said upstream and said downstream holes when said sleeve is in an open position on said tubular wall;

first and second seals between said tubular wall and said sleeve and on opposite sides of said recess; and means for blocking at least one of said upstream and downstream holes when said sleeve is in a closed position on said tubular wall.

7. Apparatus as set forth in claim 6, wherein said open position and said closed position of said sleeve are axially spaced along a length of said handle, and said apparatus further includes means for moving said sleeve axially relative to said handle.

8. Apparatus as set forth in claim 6, wherein said sleeve is adjustable to an intermediate flow position between said open and closed positions.

9. Apparatus as set forth in claim 6, and further including eductor means fastened to said tubular wall between said plug means and said outlet end for mixing a liquid additive with said liquid flowing through said flow passage.

10. Apparatus as set forth in claim 9, wherein said reservoir includes a tank for said liquid additive, and means for securing said handle to said tank, and said educator means including an educator tube extending from said handle to said reservoir.

11. Apparatus as set forth in claim 10, wherein said eductor means further includes a venturi in said flow passage, and said eductor tube is connected to a throat of said venturi.

12. Apparatus as set forth in claim 11, and further including an eductor control valve connected between said eductor tube and said throat, said eductor control valve being manually adjustable between open and closed flow positions.

13. Apparatus as set forth in claim 12, wherein said eductor control valve is further adjustable to intermediate flow positions between said open and closed flow positions.

14. A combination carrying handle and control valve for firefighting apparatus comprising:

a) a handle formed by a tubular wall having an inlet end and an outlet end and forming a flow passage between said ends;

b) coupling means fastened to said inlet end and to said outlet end for connecting said handle to a source of liquid under pressure and to an accessory, respectively;

c) plug means in said flow passage for blocking liquid flow straight through said flow passage;

d) at least one downstream hole through said wall between said plug means and said outlet end;

e) at least one upstream hole through said wall between said plug means and said inlet end;

f) a sleeve movably mounted around said tubular wall and covering said upstream hole and said downstream hole;

g) a recess in said sleeve adjacent said tubular wall and having a dimension sufficient to bridge said upstream and said downstream holes when said sleeve is in an open position on said tubular wall;

h) first and second seals between said tubular wall and said sleeve and on opposite sides of said recess;

i) means for blocking at least one of said upstream and downstream holes when said sleeve is in a closed position on said tubular wall; and j) an angled groove formed in one of said tubular wall and said sleeve and a pin fastened to another of said tubular wall and said sleeve, said pin extending into said angled groove, whereby said sleeve is moved axially as said sleeve is rotated relative to said tubular wall.

* * * * *